US008382446B2

(12) United States Patent
Reid et al.

(10) Patent No.: US 8,382,446 B2
(45) Date of Patent: Feb. 26, 2013

(54) MINI-SURGE CYCLING METHOD FOR PUMPING LIQUID FROM A BOREHOLE TO REMOVE MATERIAL IN CONTACT WITH THE LIQUID

(75) Inventors: Leslie Claud Reid, Coweta, OK (US); Ralph Loveless, Big Cabin, OK (US)

(73) Assignee: Baker Hughes Incorporated, Houston, TX (US)

( * ) Notice: Subject to any disclaimer, the term of this patent is extended or adjusted under 35 U.S.C. 154(b) by 701 days.

(21) Appl. No.: 12/436,419

(22) Filed: May 6, 2009

(65) Prior Publication Data

US 2010/0284826 A1 Nov. 11, 2010

(51) Int. Cl.

| | |
|---|---|
| ***F04B 43/12*** | (2006.01) |
| ***F04B 9/08*** | (2006.01) |
| ***G05D 7/00*** | (2006.01) |

(52) U.S. Cl. ..... 417/53; 417/390; 700/282

(58) Field of Classification Search ..... None
See application file for complete search history.

(56) References Cited

U.S. PATENT DOCUMENTS

| | | | | |
|---|---|---|---|---|
| 7,360,596 | B2 | 4/2008 | Steinbrecher et al. | |
| 2009/0000789 | A1 * | 1/2009 | Leuthen et al. | 166/369 |
| 2010/0211226 | A1 * | 8/2010 | Dowling et al. | 700/281 |

OTHER PUBLICATIONS

Bremmer, et al. "Evolving Technologies: Electrical Submersible Pumps". Oilfield Review. Winter 2006/2007. pp. 30-43.

* cited by examiner

*Primary Examiner* — Anh Mai
*Assistant Examiner* — Britt D Hanley
(74) *Attorney, Agent, or Firm* — Cantor Colburn LLP

(57) ABSTRACT

A method for removing a fluid and a material in contact with the fluid from a borehole penetrating the earth, the method including: operating a pump coupled to the borehole at a first speed for a first time interval to remove the fluid; and operating the pump at a second speed greater than the first speed for a second time interval to remove the fluid and the material.

11 Claims, 5 Drawing Sheets

MINI-SURGE CYCLING METHOD FOR PUMPING LIQUID FROM A BOREHOLE TO REMOVE MATERIAL IN CONTACT WITH THE LIQUID

BACKGROUND OF THE INVENTION

1. Field of the Invention

The invention disclosed herein relates to a method and apparatus for removing a liquid in contact with another material from an earth formation and, in particular, to using an electrical submersible pump for the removing.

2. Description of the Related Art

Electrical submersible pumps are generally used by the hydrocarbon production industry to remove a liquid from an earth formation. An electrical submersible pump (ESP) is placed in a borehole that provides access to the liquid. The ESP is electrically energized from a power supply at the surface of the earth. Thus, when energized, the ESP pumps the liquid that has entered the borehole to the surface of the earth for removal.

Other materials may also be present in the borehole. For example, a gas may be present along with the liquid in the borehole. In certain wells, the borehole may have long horizontal lengths to increase flow. It is not uncommon for an ESP to be landed in a section of a horizontal borehole that extends thousands of feet without a casing from the ESP. The geometry of the open-cased borehole is generally not perfectly horizontal allowing for high points in the borehole. The high points in turn can accumulate pockets of the gas.

During pumping operations, the pockets of gas can release all at once causing the ESP to gas lock and stop lifting fluid. Gas locking of the ESP can hamper continued flow of the liquid and water removal thus reducing production. In addition, gas locking can damage the ESP due to mechanical wear from gas affects and/or high temperature from excessive high speed as the gas flows through the ESP.

Another type of material that may be present with the liquid in the borehole is solid matter. Wellbore solids can enter the borehole at a point that is not cased. The solids entrained with the liquid can flow into and out of the ESP causing a potential for future damage. Sometimes the solids in the form of scale can build up on inner surfaces of the ESP or on inner surfaces of the production tubing. If the scale breaks off a surface, the scale may not have sufficient velocity to flow through and out of the tubing. The scale that does not exit the tubing can fall back towards the ESP and onto a check valve if used, plugging the check valve. If a check valve is not used, the scale can fall back into stages of the ESP accelerating mechanical wear, increasing power consumption, and/or plugging the ESP.

Therefore, what are needed are techniques to remove a liquid that is in contact with another type of material from a borehole penetrating the earth without damaging a pump.

BRIEF SUMMARY OF THE INVENTION

Disclosed is a method for removing a fluid and a material in contact with the fluid from a borehole penetrating the earth, the method including: operating a pump coupled to the borehole at a first speed for a first time interval to remove the fluid; and operating the pump at a second speed greater than the first speed for a second time interval to remove the fluid and the material.

Also disclosed is an apparatus for removing a fluid and a material in contact with the fluid from a borehole penetrating the earth, the apparatus having: a pump coupled to the borehole; a motor coupled to the pump; and a variable speed motor drive coupled to the motor; wherein the variable speed motor drive is configured to energize the motor to operate the pump at a first speed for a first time interval to remove the fluid and to energize the motor to operate the pump at a second speed greater than the first speed for a second time interval to remove the fluid and the material.

Further disclosed is a machine-readable medium having stored thereon a program comprising instructions that when executed perform a method for removing a fluid and a material in contact with the fluid from a borehole penetrating the earth, the method including: operating a pump coupled to the borehole at a first speed for a first time interval to remove the fluid; and operating the pump at a second speed greater than the first speed for a second time interval to remove the fluid and the material.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Figure 1:
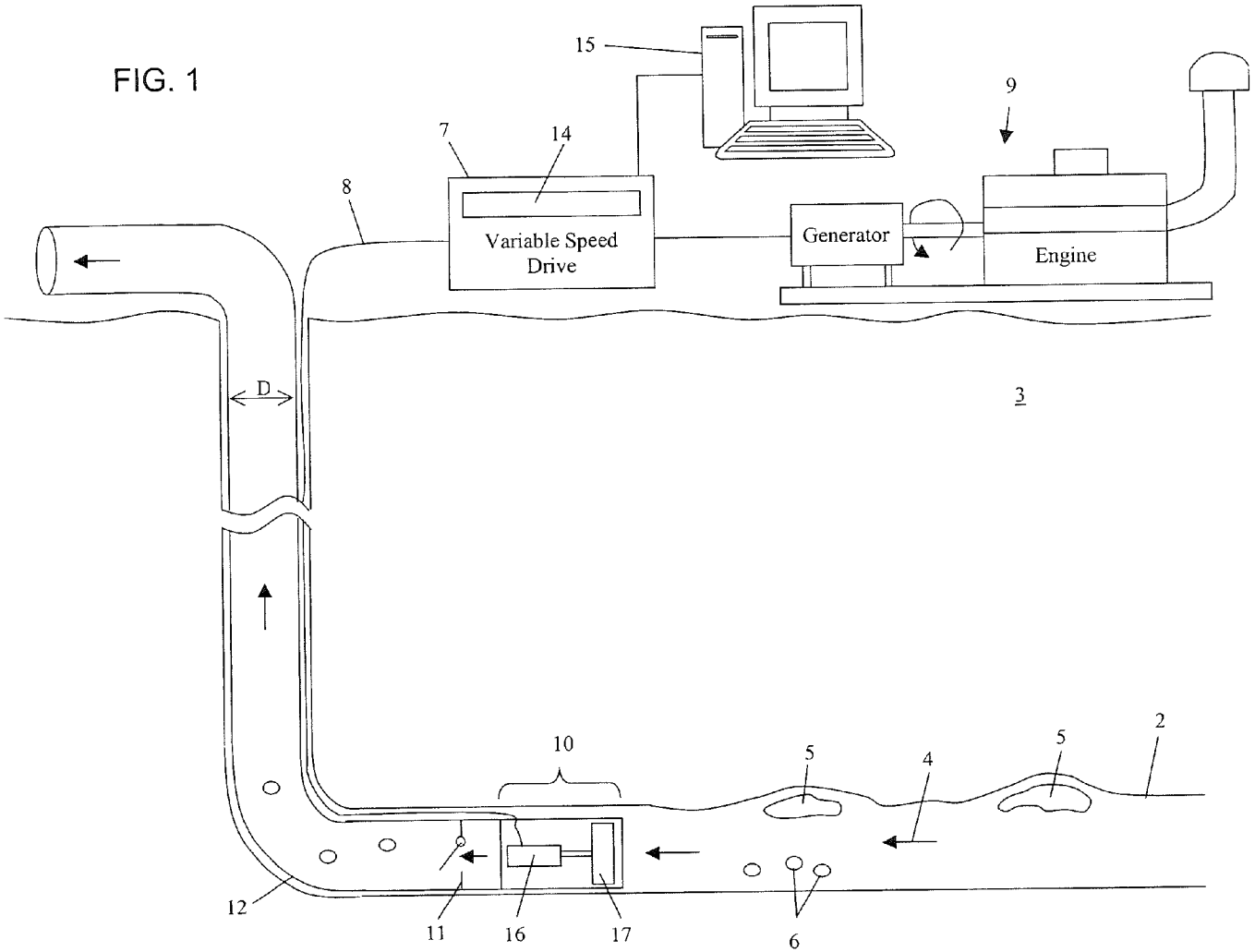
FIG. 1 illustrates an exemplary embodiment of an electrical submersible pump disposed in a borehole penetrating the earth.

Disclosed are exemplary techniques for removing a liquid, which is in contact with another type of material, from a borehole penetrating the earth. The techniques provide for not damaging a pump used for removing the liquid. The techniques call for operating the pump in a "mini-surge cycle." In the mini-surge cycle, the pump is operated at a speed higher (and corresponding higher flow rate) than the normal operating speed (i.e., rated speed or rated flow rate) for a certain time interval. After the time interval has elapsed, the pump is again operated at the normal speed, and the cycle repeats itself. The systematic "surging" of the pump according to the mini-surge cycle works to expel the other type of material from the borehole, thus prolonging pump life and reducing downtime.

The higher speed, referred to herein as the "surge speed," is selected to be at least a minimum speed (or corresponding flow rate) necessary to expel the other type of material from the pump and the borehole. In the case of a gas as the other type of material, the pump operating at the higher speed will remove pockets of the gas in horizontal runs of the borehole before the pockets of the gas become large enough to damage the pump. Thus, the mini-surge cycle works to remove the gas pockets continuously according to the time constraints of the cycle.

In the case of a solid as the other type of material, the pump operating at the higher speed will expel the solid material from the pump and the borehole. Thus, the solid material will not be able to fall back towards the pump and cause mechanical damage. As with removing the gas pockets, the mini-surge cycle works to remove solid material continuously according to the time constraints of the cycle.

For removal of solids, the mini-surge cycle can be modified to include slowing the pump speed down below the normal operating speed to a slow speed for a certain time interval (i.e., a slow speed time interval) prior to operating the pump at the surge speed. The reason for operating the pump during the slow speed is to allow the fluid level in the borehole to increase so as to increase the length of time the pump can operate at the surge speed. The longer the time interval of the high-rate flush (i.e., operation of the pump at the surge speed), the better the solids will lift out of the borehole. Without the slow speed time interval, the inflow performance of some wells may not allow sufficient time at the surge speed as the well cannot be allowed to run out of fluid and pump-off.

The modified mini-surge cycle is generally used for sand removal purposes. Another reason for operating the pump at the slow speed in the modified mini-surge cycle is so that most of the fluid comes from the annular area above the pump and to not excessively draw fluid from perforations. A high flow out of the perforations can sometimes pull sand into the borehole.

In order to prevent damage to the pump, the time interval during which the pump is operated at the higher speed is selected to be at least the minimum time sufficient to (1) expel the gas from the pump and borehole leading to the pump and/or expel the solid material from the pump and from the borehole or production tubing on the discharge side of the pump.

A trade-off between the magnitude of the higher speed and the duration of the time interval may be contemplated to optimize the expelling of the other type of material and the longevity of the pump. In one embodiment, the mini-surge cycle may operate the pump at a first high speed for a first time interval. In another embodiment, the mini-surge cycle may operate the pump at a second high speed, which is higher than the first high speed, for a second time interval that has a shorter duration than the first time interval.

Because pump speed may be correlated to the flow rate of the pump, the term "flow rate" may be used interchangeably herein with the term "speed."

FIG. 1 illustrates an exemplary embodiment of an electrical submersible pump (ESP) 10 disposed in a borehole 2 penetrating the earth 3. The borehole 2 contains a liquid 4. For teaching purposes, the borehole 2 leading to the intake of the ESP 10 is uncased and generally horizontal with some high points, which can contain pockets of gas 5. Also shown in FIG. 1 are solids 6 entrained in the liquid 4. Coupled to the discharge of the ESP 10 in FIG. 1 is a check valve 1. The discharge of the check valve 11 is coupled to tubing 12, having an inner diameter D, which discharges at the surface of the earth 3.

The ESP 10 includes an electric motor 16 coupled to a mechanical pump 17 as shown in FIG. 1. Non-limiting examples of the mechanical pump 17 include a positive displacement pump, a centrifugal pump, a rod driven progressing cavity pump configured to be disposed and driven from the surface of the earth 3, and a progressing cavity pump configured to be driven by a submersible electric motor.

Referring to FIG. 1, the ESP 10 is coupled to a variable speed drive (VSD) 7 disposed at the surface of the earth 3. A cable 8 connects the VSD 7 to the ESP 10. Power is supplied to the VSD 7 by a power source 9. The power source 9 can be an electric grid of a power company or a portable generator, as non-limiting examples. The cable 8 can conduct electric current to the ESP 10 for power and/or for signals related to monitoring the ESP 10.

The variable speed drive 7 is configured to energize the electrical submersible pump 10 with a waveform that operates the ESP 10 at a selected speed. As shown in FIG. 1, the VSD 7 includes an electronic unit 14 that is configured to operate and/or control the VSD 7, which in turn operates the ESP 10 in the mini-surge cycle or the modified min-surge cycle. The electronic unit 14 may be referred to as the controller 14. Coupled to the VSD 7 may be a processing system 15. The processing system 15 can also be configured to operate the VSD 7 in the mini-surge cycle or the modified min-surge cycle.

Figure 2:
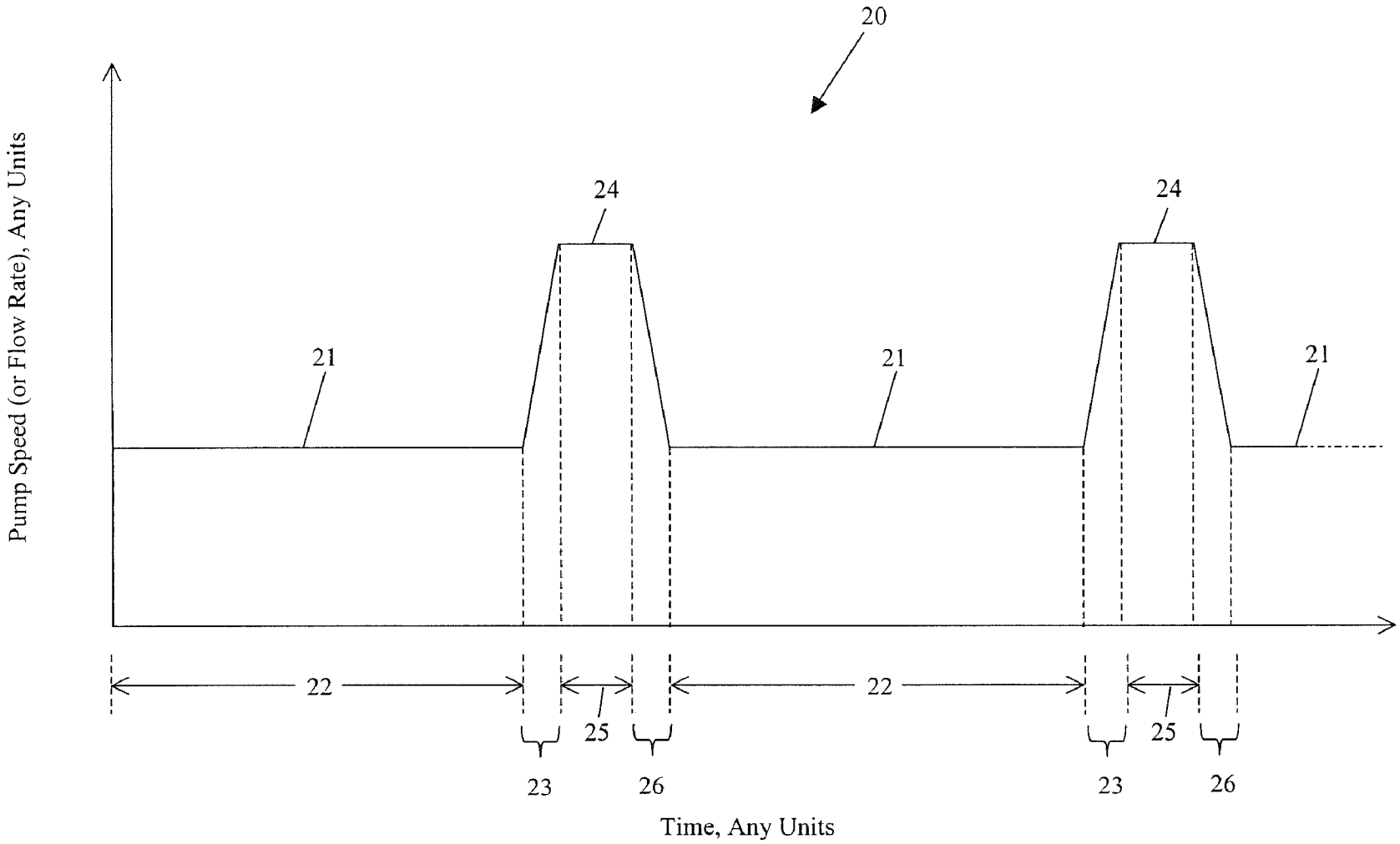
FIG. 2 depicts aspects of a mini-surge cycle used to operate the electrical submersible pump.

FIG. 2 depicts aspects of a mini-surge cycle 20. The mini-surge cycle 20 operates the ESP 10 at a normal speed 21 for a normal speed time interval 22. After the normal speed time interval 22 elapses, the mini-surge cycle 20 increases (or ramps up) the ESP 10 speed to a high speed 24, also referred to as the surge speed 24, during a ramp-up time interval 23. The mini-surge cycle 20 then operates the ESP 10 at the surge speed 24 for a surge speed time interval 25. After the surge speed time interval 25 expires, the mini-surge cycle 20 reduces (or ramps down) the speed of the ESP 10 to the normal speed 21 during a ramp-down time interval 26. Once the ESP 10 ramps down to the normal speed 21, the mini-surge cycle 20 operates the ESP 10 at the normal speed 21 for the normal time interval 21 and the cycle repeats itself.

Figure 3:
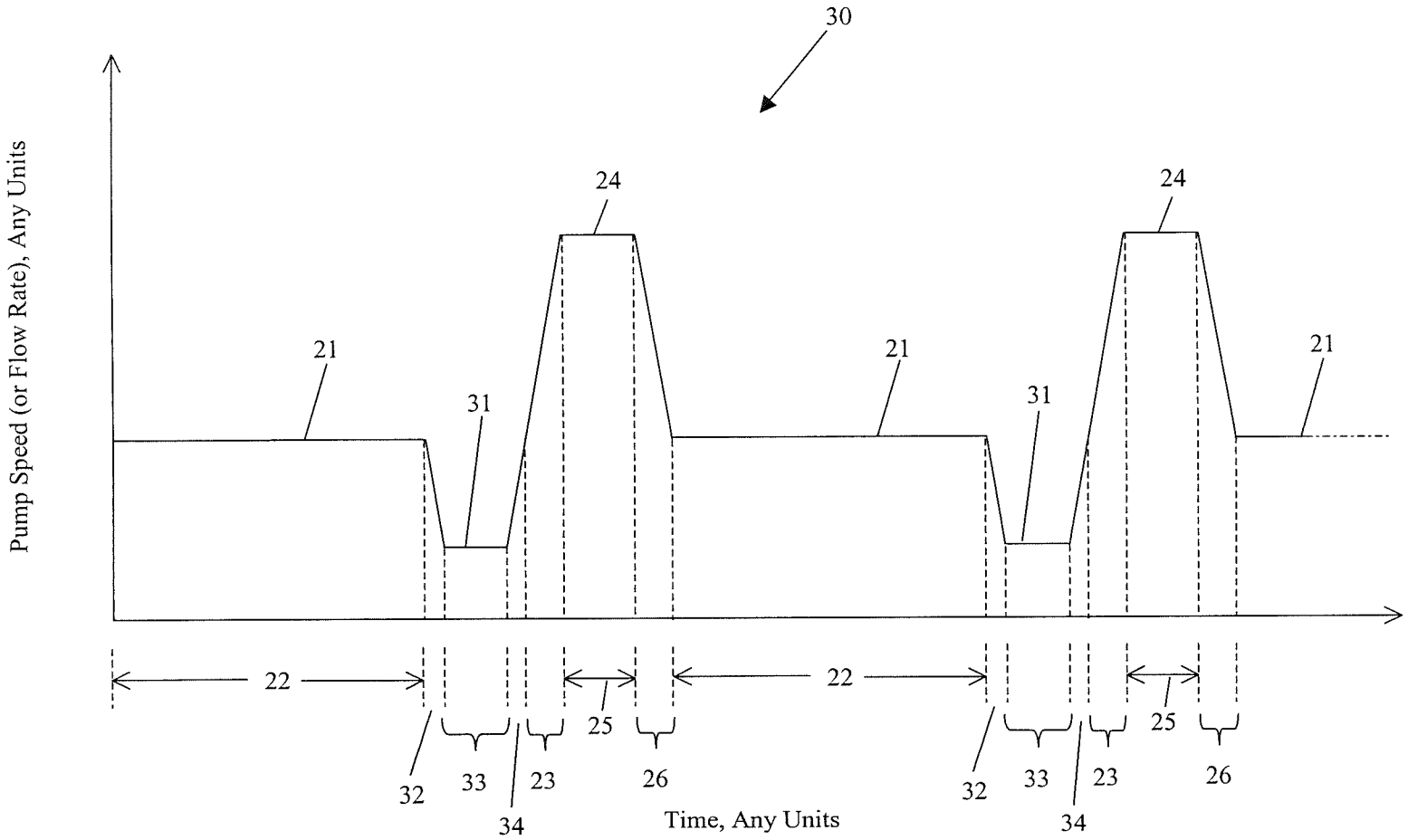
FIG. 3 depicts aspects of a modified mini-surge cycle used for removal of solids.

FIG. 3 depicts aspects of a modified mini-surge cycle 30. The modified mini-surge cycle 30 is similar to the mini-surge cycle 20 with the addition of operating the ESP 10 at a slow speed 31 for a slow speed time interval 33 prior to operating the ESP 10 at the surge speed 24. The slow speed 31 is slower than the normal speed 21. Associated with the slow speed time interval 33 are a slow speed ramp-down time interval 32 and a slow speed ramp-up time interval 34.

It is noted that the various speeds and time intervals in the mini-surge cycle 20 or the modified min-surge cycle 30 are not necessarily fixed. The various speeds and time intervals can be adjusted either manually or automatically using the controller 14 or the processing system 15 based upon receiving input from sensors monitoring the operation of the ESP 10. For example, sensors can monitor a speed, a temperature, a vibration, a flow rate, and a wear of the ESP 10.

Figure 4:
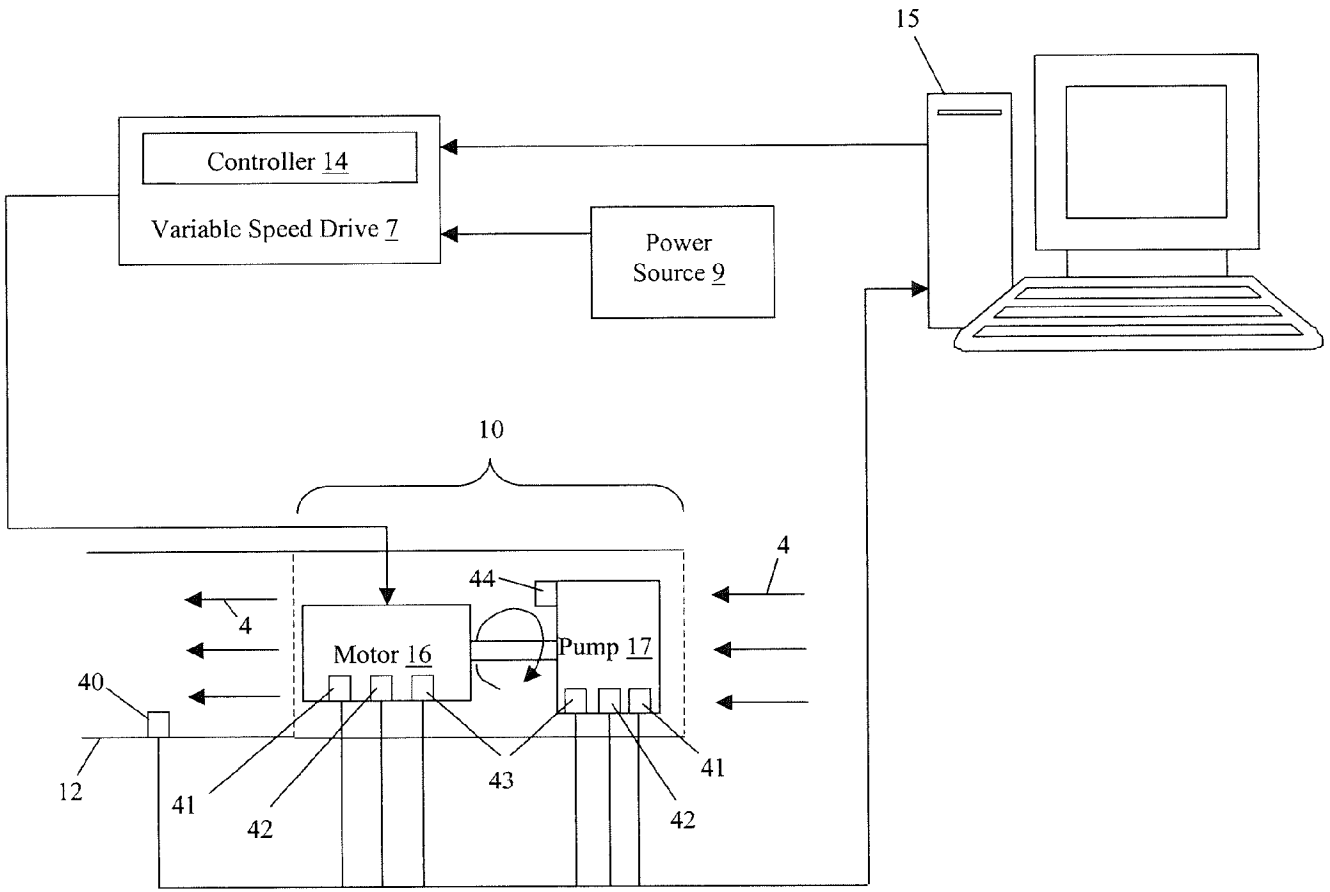
FIG. 4 depicts aspects of sensors disposed at the electrical submersible pump.

FIG. 4 depicts aspects of sensors disposed at the ESP 10. In the embodiment of FIG. 4, each of the motor 16 and the mechanical pump 17 are monitored by a speed sensor 41, a temperature sensor 42, and a vibration sensor 43. Further, as shown in FIG. 4, a wear sensor 44 is disposed at the pump 17. Although not shown, the wear sensor 44 can also be disposed at the motor 16. In addition to the sensors disposed at the ESP 10, a flow sensor 40 is shown disposed at the casing 12. The flow sensor 40 is configured to measure flow of the liquid 4.

The sensors 40-44 are coupled to the processing system 15 as shown in FIG. 3. However, in an alternative embodiment the sensors 40-44 can provide input directly to the VSD 7. The processing system 15 receives measurements from the various sensors and uses the measurements to determine optimal parameters of the mini-surge cycle 20 or the modified min-surge cycle 30. For example, if one of the temperature sensors 42 detects a temperature that exceeds a threshold value during the surge speed time interval 25, then the processing system 15 can reduce the duration of the surge speed time interval 25. Manual adjustment of parameters is also an option.

The various sensors disclosed herein can also be used to initiate operation of the mini-surge cycle 20 (or the modified min-surge cycle 30) automatically. For example, when a certain monitored aspect exceeds a threshold value, the processing system 15 (or the electronic unit 14) can automatically initiate the mini-surge cycle 20 (or the modified min-surge cycle 30) to operate the ESP 10. Manual initiation is also an option.

When the solids 6 are present in the borehole 2 and/or casing 12, a calculation can be performed to determine a flow velocity of the liquid 4 that will carry the solids 6 up and out of the borehole 2. Non-limiting inputs to the calculation include the inner diameter (D) of the casing 12 (or tubing), viscosity of the fluid 4, types of solids 6 expected, and length of the casing 12 (or tubing). A similar calculation can be used to calculate the maximum diameter (D) that will provide adequate clearing of the solids 6 for a selected flowrate of the liquid 4. A program performing similar calculations with the various input variables can develop the parameters of the mini-surge cycle 20 (or the modified min-surge cycle 30) that can maximize runtime of the ESP 10 and thereby maximize production. In addition, a well performance index can be used in the calculation to determine the slow speed 31 and the slow speed time interval 33 that would result in a maximum surge speed time interval 25.

In one embodiment, the motor 16 can be a hydraulic motor configured to be driven by a hydraulic pump, which is driven by an electric motor (i.e., electro-hydraulic operation of the pump 17). The electric motor in turn is driven by the variable speed drive 7. Thus, the VSD 7 can vary the speed of the pump 17 via the electric motor, the hydraulic pump and the motor 16.

Figure 5:
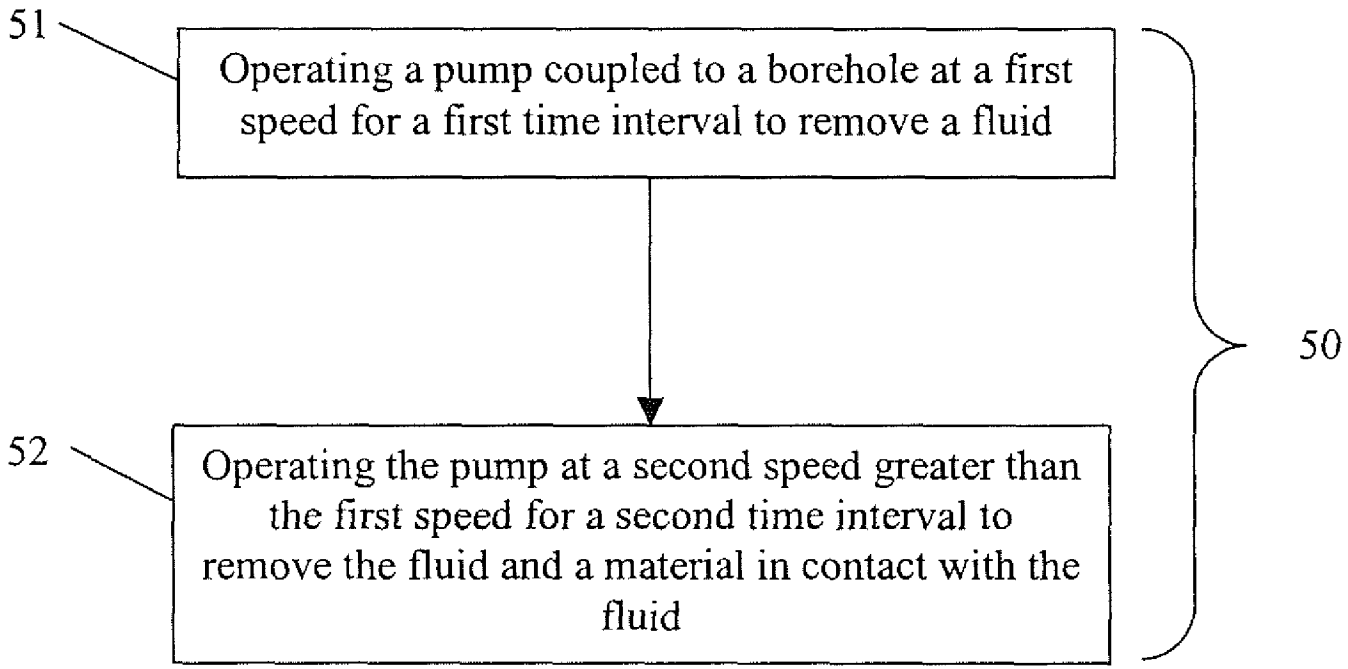
FIG. 5 presents one example of a method for removing a liquid and another type of material in contact with the fluid from the borehole.

FIG. 5 presents one example of a method 50 for removing the fluid 4 and a material in contact with the fluid 4 from the borehole 2 penetrating the earth 3. The material can be the gas 5 or the solids 6. The method 50 calls for (step 51) operating the pump 10 coupled to the borehole 2 at a first speed (i.e., the normal speed 21) for a first time interval (i.e., the normal speed time interval 22) to remove the fluid 4. The term "coupled to the borehole" relates to the pump 10 being disposed either at the surface of the earth or in the borehole and configured to pump the fluid and the material out of the borehole. Further, the method 50 calls for (step 52) operating the pump 10 at a second speed (i.e., the surge speed 24) greater than the first speed for a second time interval (i.e., the surge speed time interval 25) to remove the fluid 4 and the material. Although not shown in FIG. 5, the method 50 can include operating the pump 10 at a third speed (i.e., the slow speed 31) less than the first speed for a third time interval (i.e., the slow speed time interval 33) prior to operating the pump 10 at the second speed.

In support of the teachings herein, various analysis components may be used, including a digital and/or an analog system. For example, the electronic unit 14 or the processing system 15 can include the digital and/or analog system. The system may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a pump trim, power supply (e.g., at least one of a generator, a remote supply and a battery), pressure supply, hydraulic unit, cooling component, heating component, motive force (such as a translational force, propulsional force or a rotational force), magnet, electromagnet, sensor, transmitter, receiver, transceiver, antenna, controller, optical unit, electrical unit, electromechanical unit, electric cables or connectors may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and "third" are used to distinguish elements and are not used to denote a particular order.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for removing a liquid and a material that is not a liquid in contact with the liquid from a borehole penetrating the earth, the method comprising:

operating a pump coupled to the borehole at a first speed for a first time interval to remove the liquid and not the material; and operating the pump at a second speed greater than the first speed for a second time interval to remove the liquid and the material;

wherein the pump is operated in continuous cycles, each cycle comprising operating the pump at the first speed for the first time interval followed by operating the pump at the second speed for the second time interval.

2. The method of claim 1, each cycle further comprising operating the pump at a third speed slower than the first speed for a third time interval prior to the operating the pump at the second speed wherein the third speed is selected to allow an increase in a level of the liquid in the borehole, wherein each cycle comprises operating the pump at the first speed for the first time interval followed by operating the pump at the third speed for the third time interval followed by operating the pump at the second speed for the second time interval.

3. The method of claim 1, wherein the first speed is a normal rated speed of the pump allowing for continuous operation.

4. The method of claim 1, wherein the second speed and the second time interval are selected to prevent damage to the pump.

5. The method of claim 1, wherein the second speed and the second time interval are selected to prevent the pump from exceeding a selected temperature.

6. The method of claim 1, wherein the material is a solid.

7. The method of claim 1, wherein at least one selection from a group consisting of the first time interval, the second speed, and the second time interval is adjusted to prevent damage to the pump.

8. The method of claim 7, wherein the adjustment is based upon a measurement by a sensor sensing at least one selection from a group consisting of a pump speed, a pump temperature, a pump vibration, a pump flow rate, and a pump wear.

9. The method of claim 1 wherein the pump is disposed in the borehole.

10. A machine-readable medium having stored thereon a program comprising instructions that when executed perform a method for removing a liquid and a material that is not a liquid in contact with the liquid from a borehole penetrating the earth, the method comprising:

operating a pump coupled to the borehole at a first speed for a first time interval to remove the liquid and not the material; and operating the pump at a second speed greater than the first speed for a second time interval to remove the liquid and the material;

wherein the pump is operated in continuous cycles, each cycle comprising operating the pump at the first speed for the first time interval followed by operating the pump at the second speed for the second time interval.

11. The medium of claim 10, wherein each cycle further comprises operating the pump at a third speed slower than the first speed for a third time interval prior to the operating the pump at the second speed wherein the third speed is selected to allow an increase in a level of the liquid in the borehole.

* * * * *